US006591505B2

(12) United States Patent
Flavigny

(10) Patent No.: US 6,591,505 B2
(45) Date of Patent: Jul. 15, 2003

(54) FOLDING KNIFE WITH A LOCKING CATCH

(75) Inventor: Jean-Pierre Flavigny, Saint Pe sur Nivelle (FR)

(73) Assignee: Facom, Morangis (FR)

( * ) Notice: Subject to any disclaimer, the term of this patent is extended or adjusted under 35 U.S.C. 154(b) by 0 days.

(21) Appl. No.: 09/989,430

(22) Filed: Nov. 21, 2001

(65) Prior Publication Data

US 2002/0059730 A1 May 23, 2002

(30) Foreign Application Priority Data

Nov. 23, 2000 (FR) ..... 00 15146

(51) Int. Cl.[7] ..... B26B 1/04
(52) U.S. Cl. ..... 30/161; 30/519
(58) Field of Search ..... 30/160, 161, 356, 30/519; 7/118–120

(56) References Cited

U.S. PATENT DOCUMENTS 4,145,808 A * 3/1979 Walsh ..... 30/161 X
4,302,877 A 12/1981 Hart et al.
5,425,175 A 6/1995 Rogers
5,461,786 A 10/1995 Miller
5,887,347 A 3/1999 Gibbs
5,979,058 A 11/1999 Henke

* cited by examiner

*Primary Examiner*—Douglas D. Watts
(74) *Attorney, Agent, or Firm*—Wenderoth, Lind & Ponack, L.L.P.

(57) ABSTRACT

A knife having a handle (7), at least one blade (3) mounted so that it can pivot on the handle (7) between a position in which it is retracted into the handle (7) and an open work position, and a member (31, 41) for locking the blade (3) in the open position. In the open position, the blade makes an angle with respect to the main direction of the handle that is appreciably greater than 10° and appreciably smaller than 90°, preferably between 20° and 60°, and preferably roughly equal to 40°. The knife has application as a two-bladed electrician's knife for cutting and stripping electric cables.

31 Claims, 4 Drawing Sheets

FOLDING KNIFE WITH A LOCKING CATCH

BACKGROUND OF THE INVENTION

1. Field of the Invention

The present invention relates to a folding knife having a handle which is elongate in a main direction, at least one blade mounted so that it can pivot on the handle between a position in which it is at least partially retracted into the handle and an open work position, and a member for locking the blade in the open position.

2. Description of the Related Art

Many knives of this kind are known in the state of the art under the general term of "flick knife".

They are often relatively complicated to manufacture given the various members needed to perform the aforementioned functions. The complexity of the design is further exacerbated in the case of two-bladed folding knives, such as electricians' knives, in which one blade is designed to cut through a cable and the other blade is designed to be used for cable-stripping operations.

SUMMARY OF THE INVENTION

A main object of the invention is to produce a folding knife of the type described above, and in which the open position is stable and defined positively to guarantee longitudinal and circular cuts in complete safety.

To this end, in the open position, the blade makes an angle with respect to the main direction of the handle appreciably greater than 10° and appreciably smaller than 90°, and preferably 40°.

According to other features:

- the blade has a length of between 30 mm and 55 mm and in particular roughly equal to 45 mm;
- the blade has a concave cutting edge, the mean radius of curvature of which is between 40 mm and 60 mm, particularly roughly equal to 50 mm;
- the knife has two pivoting blades of different lengths, the first blade having a length greater than the length of the second blade, each of the blades making a respective acute angle with respect to the main direction of the handle, the angle associated with the second blade being greater than the angle associated with the first blade, appreciably greater than 10° and appreciably smaller than 90°, and preferably between 20° and 60°, and preferably roughly equal to 40°; and
- the knife has two pivoting blades of different lengths, each having a concave cutting edge with a respective curvature which is different for each blade, and each making a respective acute angle with respect to the main direction of the handle, one of the blades being associated both with the larger of the two angles and the larger of the two curvatures.

Another main object of the invention is to produce a folding knife of the aforementioned type, further comprising a member for actuating the locking member to switch the member from a locking position to an unlocked position, and a member for returning the locking member to the locking position, which is less expensive to manufacture and extremely reliable.

To this end, the actuating member and the return member are formed on a single operating piece mounted on the handle.

According to other features:

- the operating piece is a lever mounted so that it can pivot on the handle about a pin that is transverse with respect to the main direction;
- the blade has a notch and the locking member has a projection that complements the notch, formed on the lever;
- the blade has an edge forming a cam near the notch, the cam collaborating with the projection between the retracted position and the open position of the blade;
- the lever is partially retracted into the handle, and the actuating member projects from the handle on the opposite side of the lever from the locking projection with respect to the pivot pin of the lever;
- the lever has three branches arranged roughly in a Y-configuration in a longitudinal plane of the handle, and its pivot pin lies roughly at the region where the three branches meet, two of the three branches supporting, respectively, the locking member and the actuating member, while the other branch constitutes the return member;
- the handle is secured to at least one transverse relief and the branch constituting the return member has a free end part which bears on the relief so that pressure exerted on the actuating member causes elastic deformation of the branch and generates an elastic return force on the lever, returning it towards a position of rest of the lever;
- when the lever is in the position of rest, either the blade is in its open position and the projection is engaged in the notch, or the blade is in the retracted position in the handle and the projection rests against the cam, creating a force on the blade that opposes the opening thereof;
- the cam and the projection are configured in such a way that the elastic action of the lever on the blade tends to bring the blade into one or other of its positions: open and retracted;
- the knife has two blades each associated with an operating piece, and which pivot with respect to the handle about a common pivot pin; and
- the two blades are associated with a common operating piece formed between them in the handle.

BRIEF DESCRIPTION OF THE DRAWINGS

An exemplary embodiment of the invention will now be described with reference to the appended drawings, in which.

DETAILED DESCRIPTION OF THE INVENTION

Figure 1:
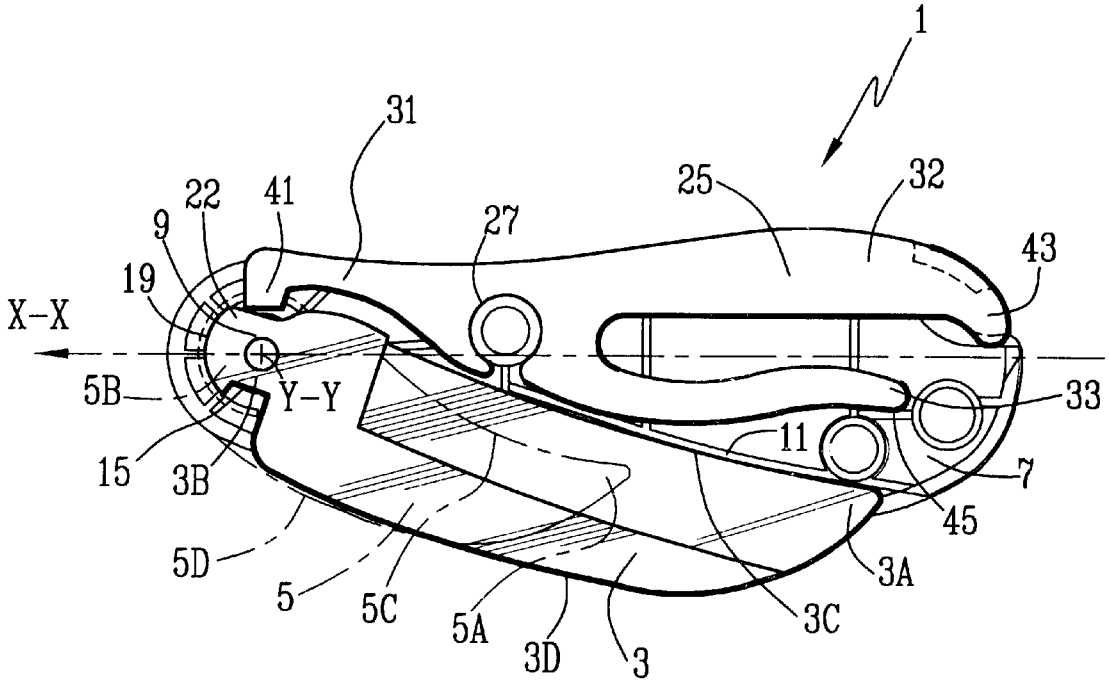
FIG. 1 is a view in a longitudinal plane, passing through the handle and containing the first blade, of a two-bladed knife according to the invention, the blades being folded.

FIG. 1 depicts a knife 1 with two folding blades 3, 5, the first of which is a long blade 3 and the second of which is a short blade 5. The knife 1 has a handle 7 which is elongate in a main direction X—X and slit by two parallel slots intended to house the blades 3 and 5, respectively. In FIG. 1, the knife is viewed in the plane of the slot that accommodates the long blade 3.

The two blades 3, 5 are mounted so that they can pivot on the handle 7 about a common axis Y—Y embodied by a journal 9.

The main direction X—X of the handle 7 is defined more specifically with respect to axis Y—Y of pivoting as being the axis which, in the plane of a blade 3, 5 connects the axis of pivoting Y—Y and the proximal end of the handle 7.

Each blade 3, 5 has a pointed respective free end 3A, 5A and an opposite end 3B, 5B for articulation about the journal 9.

Figure 3:
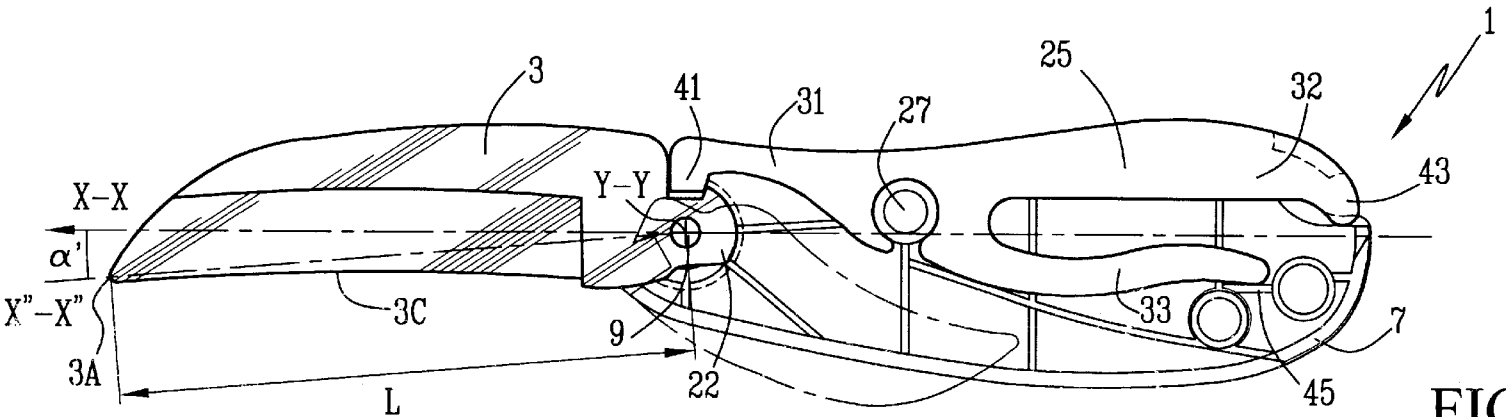
FIG. 3 is a view similar to FIG. 1, the first blade being folded out.
Figure 4:
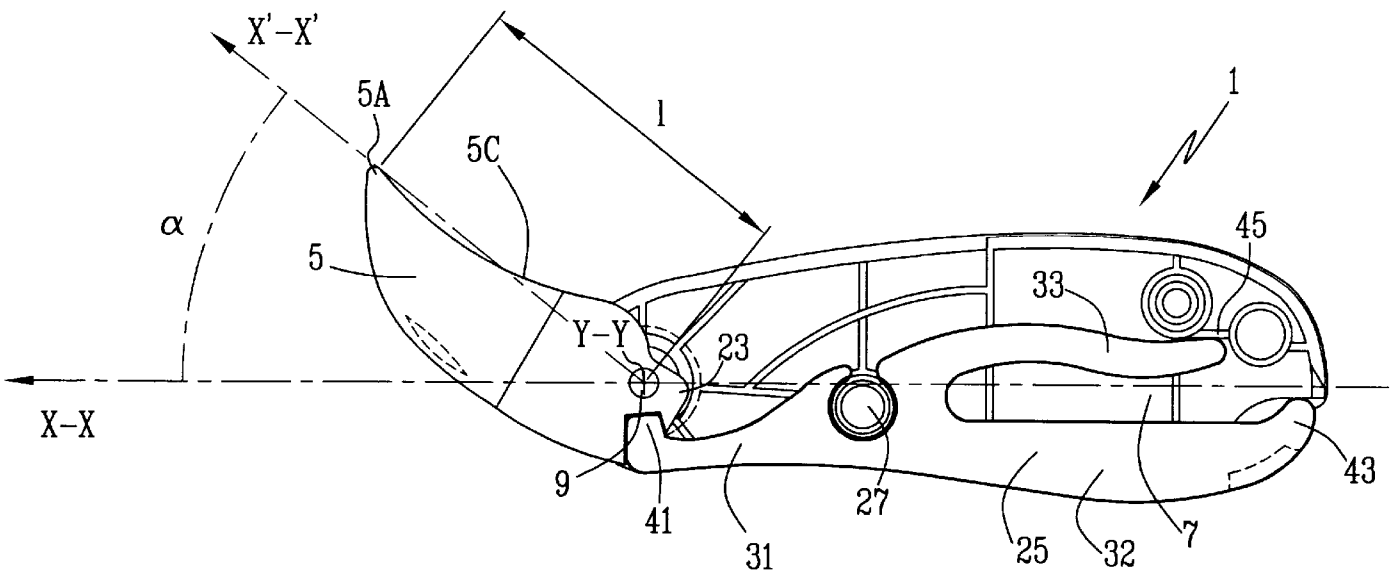
FIG. 4 is a view similar to FIG. 2, the second blade being folded out.

Each blade 3, 5 is mounted so that it can pivot with respect to the handle 7 about the axis Y—Y, so as to be movable between a position in which it is folded or partially retracted into the corresponding slot of the handle 7, and a folded-out or open work position, as depicted in FIGS. 3 and 4. In the work position, the blade 3 runs more or less in the continuation of the handle 7.

Figure 2:
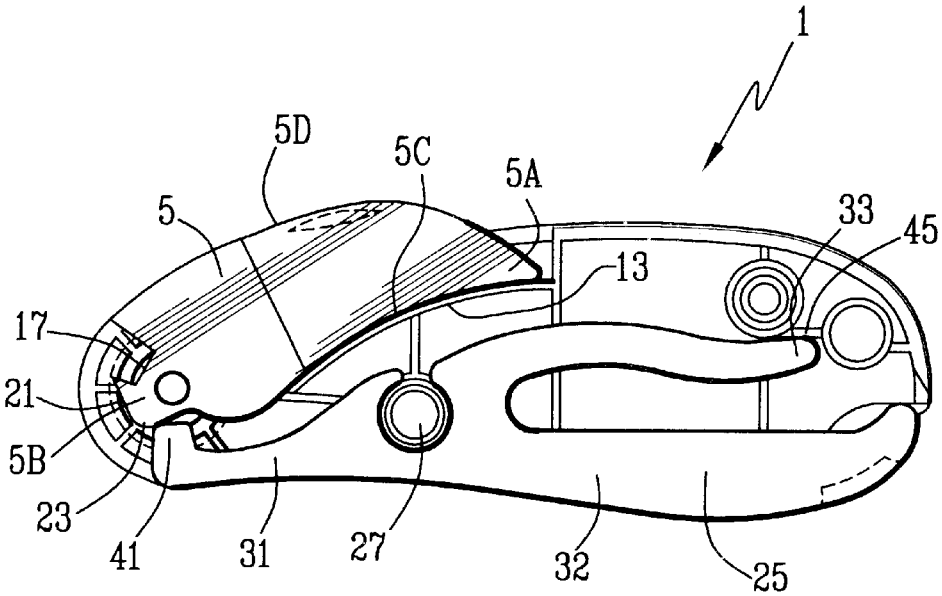
FIG. 2 is a view in the parallel plane containing the second blade of the knife shown in FIG. 1 turned through 180° about the longitudinal axis that embodies the main direction of the handle.

With reference to FIGS. 1 and 2, each blade 3, 5 has a concave respective cutting edge 3C, 5C and an outside edge 5D. When the blade is in the retracted position, the cutting edge 3C, 5C rests against a rib 11, 13 of complementary shape formed in the handle at the bottom of the slot. The ribs 11, 13 constitute a rotational end stop for the respective blade 3, 5.

Each blade 3, 5 has a respective notch 15, 17 formed in the articulation end part 3B, 5B on the outside edge 3D, 5D side. The edge of the blade 3, 5 delimiting the articulation end 3B, 5B and connecting the notch 15, 17 to the cutting edge 3C, 5C constitutes a cam 19, 21. Each cam 19, 21 has a respective angular point 22, 23 in an intermediate part.

The knife 1 has an operating piece 25 consisting of a lever mounted so that it can rotate on the handle 7 about a cylindrical stud 27 extending from the handle 7 into both of the slots that accommodate the blades 3, 5. The stud 27 is formed in an intermediate region of the handle 7, along its longitudinal axis X—X corresponding to the main direction.

The lever 25 is a Y-shaped piece, the three branches 31, 32, 33 of which extend into each of the slots that accommodate the blades 3, 5.

The operating piece 25 described in this particular embodiment of the invention is a single operating piece associated with both blades 3, 5, but it is possible as an alternative to provide two separate operating pieces 25, each respectively associated with one of the blades 3, 5 and capable of pivoting independently with respect to the handle 7.

The operating piece, or lever, 25 is formed as one piece.

The branch 31 constitutes a member for locking the blades 3, 5 in their open work position, the branch 32 constitutes an actuating member protruding from the handle 7 so as to be operable by the user, and the branch 33 constitutes a member for elastically returning the lever 35 to its position of rest.

The branch 31 corresponding to the locking member has, at its free end, adjacent to the articulation end 3B, 5B of the blades 3, 5, a projection 41 facing towards the articulation journal 9 and complementing the notches 15, 17, so as to able to immobilize one or the other of the blades in the open position (this position has been depicted in FIGS. 3 and 4).

The branch 32, which corresponds to the actuating member, runs more or less as a continuation of the branch 31 so that, when the lever 25 is in the position of rest, it coincides with an outside edge of the handle 7. Only a free end part 43 forming an operating button, at the opposite end relative to the projection 41 and to the journal 9, protrudes appreciably from the overall bulk or profile of the handle 7. The handle is formed with a recess in this region.

The branch 33 corresponding to the elastic return member extends, when the blades 3, 5 are in the retracted position in the handle 7, between the branch 32 corresponding to the actuating member and the blades 3, 5. The free end of the branch 33, which corresponds to the elastic return member, rests on a rib 45 of the handle 7 forming a stop. The rib 45 opposes or prevents the clockwise pivoting of the return branch 33, and at the same time the other two branches 31, 32, about the stud 27.

Reference is now made to FIGS. 3 and 4 which respectively depict the knife in the positions in which the long blade 3 and the short blade 5 are in the open work positions.

Here we define the main direction of a blade 3, 5 by the axis which, in the plane of the blade, connects the axis of pivoting Y—Y and the tip 3A, 5A, namely the distal end.

The length L, 1 of a blade 3, 5 is also defined as the distance from its tip 3A, 5A to the axis of pivoting Y—Y.

The length 1 of the short blade 5 is advantageously chosen to be between 30 mm and 55 mm, particularly roughly equal to 45 mm according to the preferred embodiment which has been depicted.

It is more clearly apparent from these figures that the mean curvature of the concave cutting edge 5C of the short blade 5 is greater than the mean curvature of the concave cutting edge 3C of the long blade 3. Advantageously, the mean radius of curvature of the short blade 5 is between 40 mm and 60 mm, particularly roughly equal to 50 mm.

Furthermore, in the open position, the long blade 3 has a main direction X"—X" which makes an angle $\alpha'$ smaller than 10° with the longitudinal axis X—X of the handle 7, whereas the acute angle $\alpha$ formed between the main direction X—X of the handle 7 and the main direction X'—X' of the short blade 5 is appreciably greater than 10° and smaller than 90°, preferably between 20° and 60°, and more preferably still roughly equal to 40°.

The type of knife thus designed is particularly suited to use by electricians, the long blade 3 being particularly well-suited to cutting through electric cables and the short blade 5 being particularly suited to stripping them.

In the positions depicted in FIGS. 1 to 4, the lever 25 is in its rest position, that is to say that the return branch 33 is hardly or not stressed in bending on the rib 45. It will therefore be appreciated that the open position of one of the blades 3, 5 (or both blades, but this does not correspond to normal use) corresponds to the position of rest of the lever 25. The same is true of the retracted position of one or both blades 3, 5.

Figure 5:
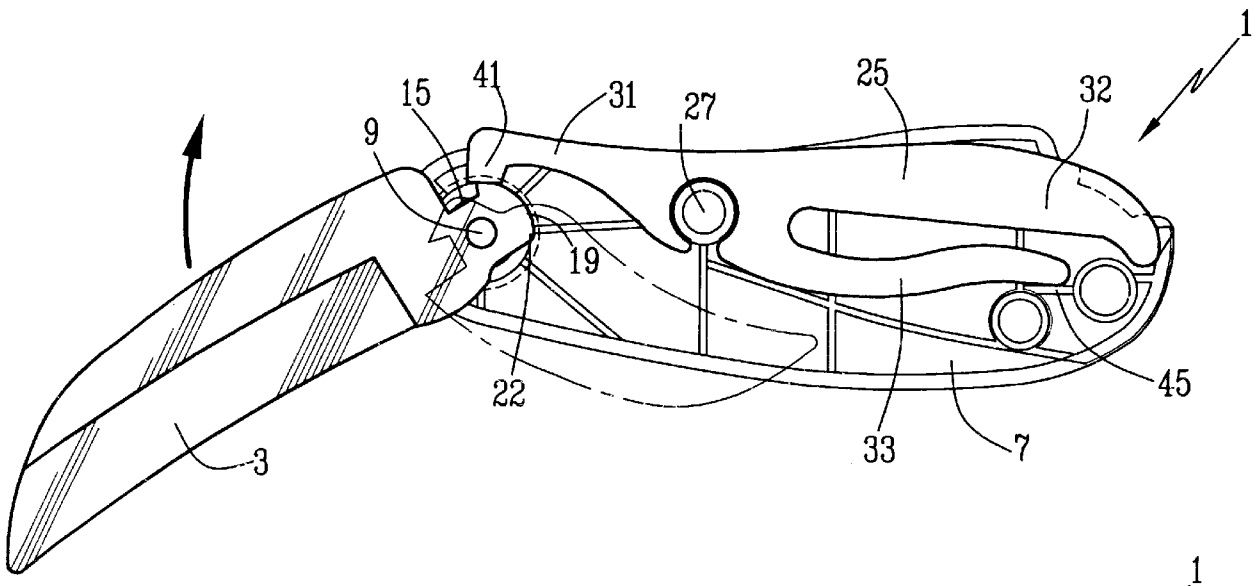
FIG. 5 is a view similar to FIG. 1, illustrating the opening of the first blade to a folded-out position.
Figure 6:
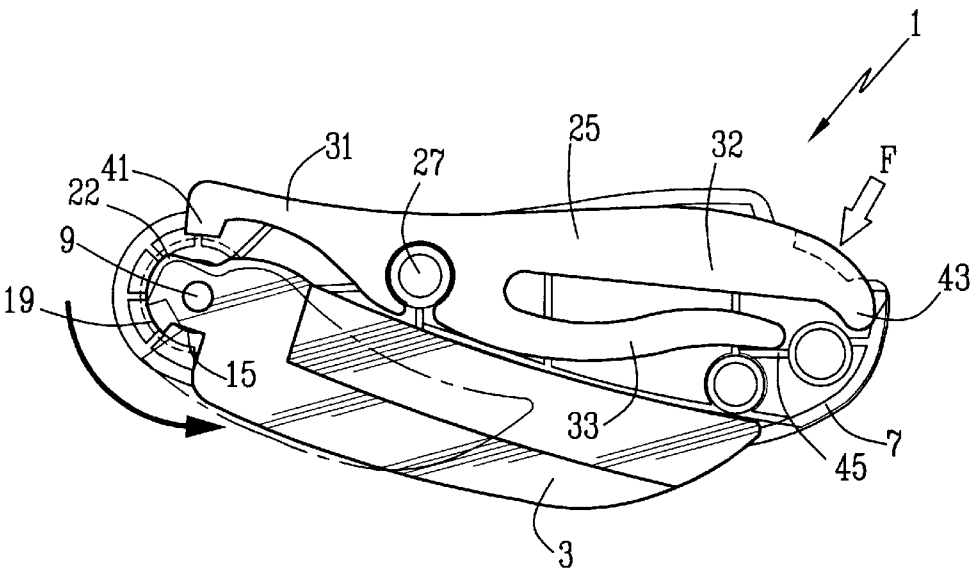
FIG. 6 is a view similar to FIG. 5, illustrating the movement of the first blade from a folded-out position to a folded position.

With reference now to FIGS. 5 and 6, the movement of the long blade 3 from one of its extreme positions to the other, that is to say the open work position and the retracted position in the handle 7, will be described. Operation regarding the other blade 5 is exactly the same, and it therefore seems unnecessary to illustrate it.

As can be seen in FIG. 5, which corresponds to a phase of opening the blade 3 out of the handle 7, the projection 41 bears against the cam 21 during the phase of angular excursion of the blade 3 about the journal 9, so that the lever 25 pivots about the stud 27 and the return branch 33 is elastically deformed by butting against the rib 45. It will be appreciated that the lever 25, via the projection 41 exerts, between the retracted position and the open position of the blade 3, a return force on the blade 3 so as to cause it to tend towards one or the other of its extreme positions.

It will be understood more specifically that the cam 19 is configured so that the lever 25 exerts a return force returning the blade 3 towards its open position when the projection 41 bears against that part of the cam 19 that lies between the notch 15 and the angular point 22. Whereas the lever 25 exerts a force returning the blade 3 towards its retracted position when the projection 41 bears against the part of the cam 19 that lies on the other side of the angular point 22. The angular point 22 defines a "hard point" corresponding to a peak of effort that the user has to furnish in order to open the blade 3.

At the end of the excursion of the blade 3, which corresponds to the travel of the projection 41 along the cam 19, the projection 41 drops into the notch 15, and then the lever 25 returns to its rest position (the position depicted in FIG. 3). It will be readily understood that in the open position, the blades 3 and 5 are in the locked position, and are therefore very stable for making longitudinal and circular cuts.

FIG. 6 illustrates the movement of the blade 3 from its open position to its retracted position, and the action needed on the part of the user in order to perform this operation. As indicated by the arrow F, the user has to exert pressure on the button 43 against the elastic return force of the return branch 33 of the lever 25 so as to disengage the projection 41 from the notch 15 and be able to return the blade 3 to its retracted position in the handle 7, through a movement of angular excursion of the blade in the counterclockwise direction.

Figure 7:
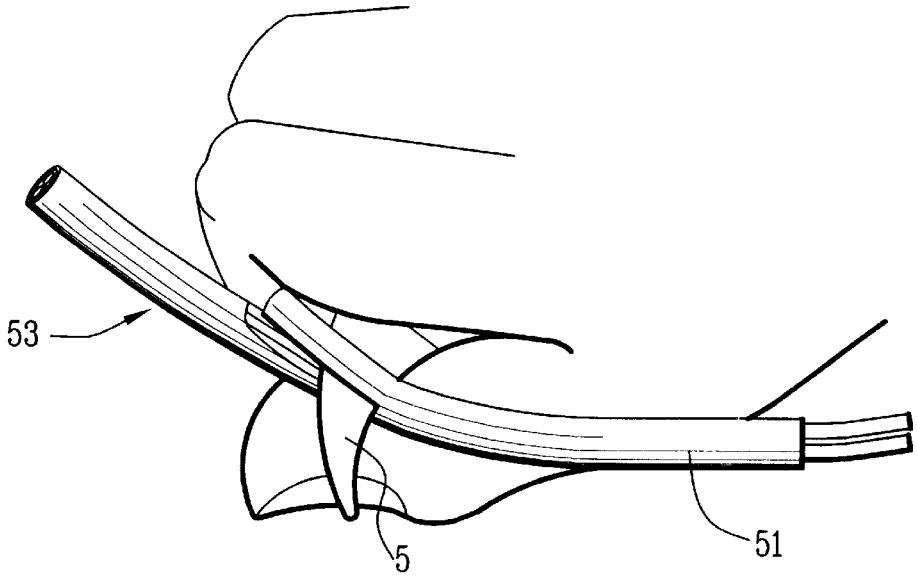
FIG. 7 is a schematic view showing the use of the second blade for longitudinally cutting through the insulating sheath of an electric cable.

FIG. 7 illustrates one mode of use of the short blade 5, which consists in cutting tangentially through the insulating sheath 51 of an electric cable 53, in the longitudinal direction of the cable.

Figure 8:
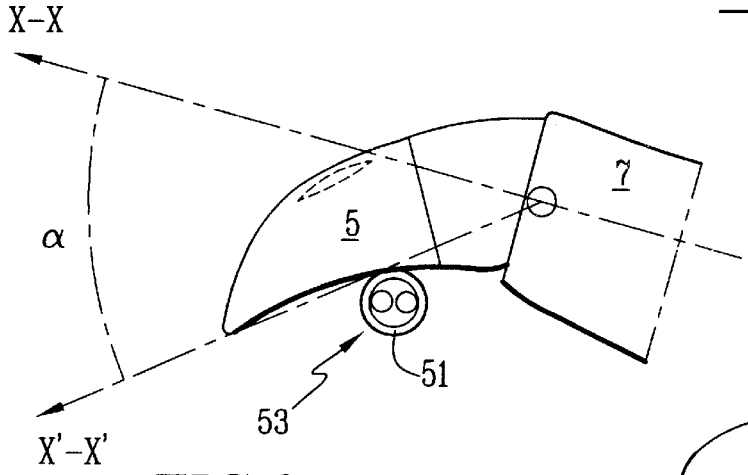
FIGS. 8 and 9 are similar views depicting circular cutting of the sheath of the cable.
Figure 9:
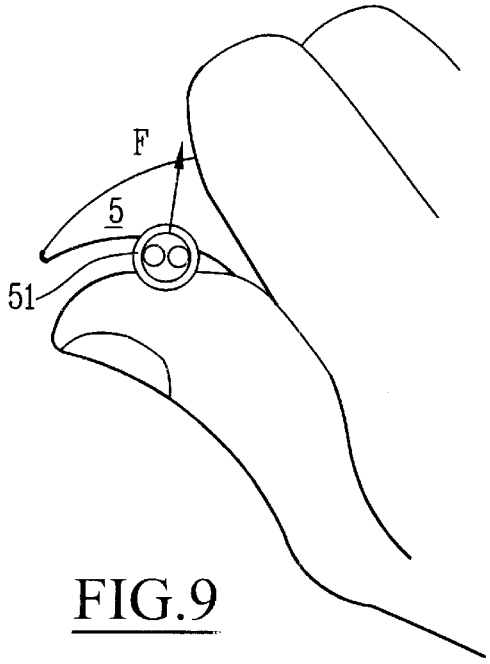

FIGS. 8 and 9 depict an operation of making a circular radial cut through an insulating sheath 51 of an electric cable 53 prior to pulling off in the longitudinal direction the section of sheath thus cut.

It is evident from these figures that when making longitudinal tangential and circular radial cuts in an electric cable of circular cross section, for example, the inclination, the exterior shape and the curvature of the cutting edge of the short blade 5 encourage the cable to be held centrally between the cutting edge and the thumb of the user. In the case of a circular cut, the inclination and curvature of the cutting edge of the blade 5 guarantee that the cable is held centrally with respect to the force F of the thumb, which makes it possible, as the knife is rotated about the cable, to remain in the circular cutting groove. This thus avoids any helical cutting.

As can be seen, the invention makes it possible to produce a folding knife, particularly an electrician's two-bladed knife, which has a short blade particularly suited to the work of peeling and stripping electric cables, and which, in its open position, is inclined at 45° and in a stable manner with respect to the axis of the handle and which also has an operating piece provided with the locking, operating and elastic return functions, this piece being of simple design and easy to manufacture. For example, this piece is made of metal so that it maintains good elastic properties over time and is able to withstand a great many operating cycles.

What is claimed is:

1. A folding knife comprising:

a handle which is elongate in a main direction (X—X);

a first blade pivotally mounted on said handle such that said first blade can pivot between a retracted position in which it is at least partially retracted into said handle and an open work position; and a second blade having a concave cutting edge and being pivotally mounted on said handle such that said second blade can pivot between a retracted position in which it is at least partially retracted into said handle and an open work position, said first blade having a length that is greater than the length of said second blade, each of said first and second blades, when in the open work position, form a respective acute angle with respect to the main direction (X—X) of said handle, the angle formed by said second blade being greater than the angle formed by said first blade, wherein the acute angle formed by said second blade, when in the open work position, is greater than 10° and smaller than 90°; and a locking member for locking said first and second blades in the open work position.

2. A folding knife according to claim 1, wherein said second blade is between 30 mm and 55 mm in length.

3. A folding knife according to claim 2, wherein the length of said second blade is approximately equal to 45 mm.

4. A folding knife according to claim 1, wherein a mean radius of curvature of said second blade is between 40 mm and 60 mm.

5. A folding knife according to claim 4, wherein a mean radius of curvature of said second blade is approximately equal to 50 mm.

6. A folding knife according to claim 4, wherein the acute angle formed by said second blade, when in the open work position, is between 20° and 60°.

7. A folding knife according to claim 4, wherein the acute angle formed by said second blade, when in the open work position, is approximately equal to 40°.

8. A folding knife comprising:

a handle which is elongate in a main direction (X—X);

a first blade pivotally mounted on said handle such that said first blade can pivot between a retracted position in which it is at least partially retracted into said handle and an open work position; and a second blade pivotally mounted on said handle such that said second blade can pivot between a retracted position in which it is at least partially retracted into said handle and an open work position, said first blade having a length that is different than the length of said second blade, each of said first and second blades forming a respective acute angle with respect to the main direction (X—X) of said handle, the angle formed by said second blade being greater than the angle formed by said first blade, and the angle formed by said second blade being greater than 10° and smaller than 90°, wherein each of said first and second cutting blades has a concave cutting edge, and the curvature of said second blade is greater than the curvature of said first blade; and a locking member for locking said first and second blades in the open position.

9. A folding knife according to claim 8, wherein the length of said second blade is approximately 45 mm.

10. A folding knife according to claim 8, wherein a mean radius of curvature of said second blade is between 40 mm and 60 mm.

11. A folding knife according to claim 10, wherein the mean radius of curvature of said second blade is approximately equal to 50 mm.

12. A folding knife according to claim 8, wherein the acute angle formed by said second blade, when in the open work position, is between 20° and 60°.

13. A folding knife according to claim 8, wherein the acute angle formed by said second blade, when in the open work position, is approximately equal to 40°.

14. A folding knife comprising:

a handle which is elongate in a main direction (X—X);

a blade having a concave cutting edge and being pivotally mounted on said handle such that said blade can pivot between a retracted position in which it is at least partially retracted into said handle and an open work position, said blade, when in the open work position, forming an acute angle with respect to the main direction (X—X) of said handle that is greater than 10° and smaller than 90°; and an operating member mounted on said handle, said operating member including:

a locking member for locking said blade in the open work position;

an actuating member for actuating said locking member to switch said locking member from a locked position to an unlocked position; and a return member for returning said locking member to the locked position, wherein said locking member, said actuating member, and said return member are integrally formed as a single piece.

15. A folding knife according to claim 14, wherein the acute angle formed by said blade, when in the open work position, is between 20° and 60°.

16. A folding knife according to claim 14, wherein the acute angle formed by said blade, when in the open work position, is approximately equal to 40°.

17. A folding knife according to claim 14, wherein said operating piece is a lever mounted on said handle via a pivot pin that extends in a transverse direction with respect to the main direction (X—X).

18. A folding knife according to claim 14, wherein said blade has a notch and said locking member has a projection that has a complementary shape with respect to the notch.

19. A folding knife according to claim 14, wherein said blade has an edge forming a cam near the notch, and the cam cooperates with the projection between the retracted position and the open work position of said blade.

20. A folding knife according to claim 17, wherein the lever is partially retracted into said handle, and said actuating member projects from said handle, and said actuating member and said locking member are located on opposite sides of the lever with respect to the pivot pin.

21. A folding knife according to claim 17, wherein said lever has three branches defined by said locking member, said actuating member, and said return member, and the three branches are arranged generally in a Y-configuration in a longitudinal plane of said handle, and the pivot pin lies in a region where the three branches meet.

22. A folding knife according to claim 21, wherein said handle includes at least one transverse relief, and said return member has a free end part which bears on the relief so that pressure, exerted on said actuating member, causes elastic deformation of said return member so as to generate an elastic return force on said lever for returning it towards a rest position.

23. A folding knife according to claim 22, further comprising a second blade having a different length in relation to said first mentioned blade, said second blade having a concave cutting edge with a respective curvature which is different in relation to said first mentioned blade, said second blade forming a respective acute angle with respect to the main direction of said handle, said first mentioned blade forming a larger acute angle and having a larger curvature relative to said second blade.

24. A folding knife according to claim 22, wherein said blade has an edge forming a cam near the notch, the cam cooperating with the projection between the retracted position and the open work position of said blade, and wherein, when said lever is in the rest position, said blade is in the open work position and the projection is engaged in the notch, or said blade is in the retracted position and the projection rests against the cam creating a force on said blade that opposes the opening thereof.

25. A folding knife according to claim 24, wherein the cam and the projection are configured in such a way that the elastic action of said lever on said blade tends to bring said blade into one of the open work position and the retracted position.

26. A folding knife according to claim 14, further comprising a second blade, and each of said first and second blades are associated with said operating member, and each of said first and second blades pivot with respect to said handle about a common pivot pin.

27. A folding knife according to claim 26, wherein said operating member is disposed between said first and second blades in said handle.

28. A folding knife according to claim 14, wherein said blade is between 30 mm and 55 mm in length.

29. A folding knife according to claim 14, wherein the length of said blade is approximately equal to 45 mm.

30. A folding knife according to claim 14, wherein the mean radius of curvature of said blade is between 40 mm and 60 mm.

31. A folding knife according to claim 14, wherein the mean radius of curvature of said blade is between 40 mm and 60 mm.

* * * * *